US009732770B2

(12) United States Patent
Yudate et al.

(10) Patent No.: US 9,732,770 B2
(45) Date of Patent: Aug. 15, 2017

(54) DRIVE CONTROL SYSTEM OF OPERATING MACHINE, OPERATING MACHINE INCLUDING DRIVE CONTROL SYSTEM, AND DRIVE CONTROL METHOD OF OPERATING MACHINE

(71) Applicant: KAWASAKI JUKOGYO KABUSHIKI KAISHA, Kobe-shi, Hyogo (JP)

(72) Inventors: Yoji Yudate, Kobe (JP); Kazuya Iwabe, Kobe (JP); Hideyasu Muraoka, Akashi (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 67 days.

(21) Appl. No.: 14/782,454

(22) PCT Filed: Apr. 3, 2014

(86) PCT No.: PCT/JP2014/001938
§ 371 (c)(1),
(2) Date: Oct. 5, 2015

(87) PCT Pub. No.: WO2014/162745
PCT Pub. Date: Oct. 9, 2014

(65) Prior Publication Data

US 2016/0040690 A1 Feb. 11, 2016

(30) Foreign Application Priority Data

Apr. 5, 2013 (JP) ..... 2013-079389

(51) Int. Cl.
*F15B 15/08* (2006.01)
*E02F 9/12* (2006.01)
(Continued)

(52) U.S. Cl.
CPC ..... *F15B 15/088* (2013.01); *E02F 9/123* (2013.01); *E02F 9/2285* (2013.01);
(Continued)

(58) Field of Classification Search
CPC ..... F15B 15/088; F15B 11/028; E02F 9/2285
(Continued)

(56) References Cited

U.S. PATENT DOCUMENTS 6,666,022 B1 * 12/2003 Yoshimatsu ..... B60K 6/46 60/413
7,086,226 B2 * 8/2006 Oguri ..... E02F 9/2075 60/414
(Continued)

FOREIGN PATENT DOCUMENTS

EP 2573281 A1 * 3/2013 ..... E02F 9/123
JP 2003-284208 A 10/2003
JP 2012-062653 A 3/2012

OTHER PUBLICATIONS

Nov. 11, 2016 Extended European Search Report issued in European Patent Application No. 14778453.2.
(Continued)

*Primary Examiner* — Thomas E Lazo
(74) *Attorney, Agent, or Firm* — Oliff PLC

(57) ABSTRACT

A drive control system of a hydraulic excavator includes a control device. When accelerating a turning body to a target turning speed, the drive control device controls an operation of the electric motor driving device such that the electric motor outputs high efficiency torque by which a highest electric power efficiency is obtained at the target turning speed. The control device controls an operation of an oil pressure supply device such that residual torque obtained by subtracting the high efficiency torque from target torque is output from an oil-pressure motor.

7 Claims, 5 Drawing Sheets

(51) Int. Cl.
*E02F 9/22* (2006.01)
*F15B 11/028* (2006.01)

(52) U.S. Cl.
CPC ..... *E02F 9/2296* (2013.01); *F15B 11/028* (2013.01); *F15B 2211/20546* (2013.01); *F15B 2211/6313* (2013.01); *F15B 2211/6336* (2013.01); *F15B 2211/6652* (2013.01); *F15B 2211/7058* (2013.01); *F15B 2211/755* (2013.01)

(58) Field of Classification Search
USPC ..... 60/448
See application file for complete search history.

(56) References Cited

U.S. PATENT DOCUMENTS 7,242,311 B2 * 7/2007 Hoff ..... E02F 9/20 340/425.5
7,279,801 B2 * 10/2007 Kagoshima ..... B60K 6/46 180/312
8,544,576 B2 * 10/2013 Shono ..... B60K 6/365 180/65.1
9,518,370 B2 * 12/2016 Tsukamoto ..... E02F 3/435
2007/0108837 A1 * 5/2007 Ohkubo ..... B60T 8/4081 303/122.08
2008/0317574 A1 * 12/2008 Moriya ..... E02F 9/128 414/687
2011/0167811 A1 7/2011 Kawaguchi et al.

OTHER PUBLICATIONS

Jun. 24, 2014 International Search Report issued in International Patent Application No. PCT/JP2014/001938.
Oct. 6, 2015 International Preliminary Report on Patentability issued in International Patent Application No. PCT/JP2014/001938.

* cited by examiner

DRIVE CONTROL SYSTEM OF OPERATING MACHINE, OPERATING MACHINE INCLUDING DRIVE CONTROL SYSTEM, AND DRIVE CONTROL METHOD OF OPERATING MACHINE

TECHNICAL FIELD

The present invention relates to a drive control system of an operating machine which causes a liquid-pressure motor and an electric motor to cooperate with each other to turn a structure of the operating machine, an operating machine including the drive control system, and a drive control method of the operating machine.

BACKGROUND ART

Operating machines, such as hydraulic excavators and cranes, are publicly known. These operating machines can perform various work by moving operating devices, such as shovels and cranes. Such an operating machine includes a lower body configured to be able to travel. A revolving super structure is provided on the lower body. The operating device, such as the shovel or the crane, is attached to the revolving super structure. The revolving super structure is configured to be turnable relative to the lower body and can change a direction of the operating device. The revolving super structure configured as above is configured to be able to be turned by a drive control system.

One example of the drive control system is disclosed in PTL 1. The drive control system of PTL 1 includes an electric motor and an oil-pressure motor. The electric motor and the oil-pressure motor cooperate with each other to turn the revolving super structure. An output torque of the electric motor and an output torque of the oil-pressure motor are controlled by a control device. When turning the revolving super structure, the control device calculates torque (i.e., maximum torque) which can be output from the electric motor. Then, the control device causes the electric motor to output the maximum torque. Further, the control device causes the oil-pressure motor to output residual torque. Since the oil-pressure motor and the electric motor cooperate with each other to turn the revolving super structure as above, energy necessary to drive the oil-pressure motor is reduced in the drive control system of PTL 1.

CITATION LIST

Patent Literature

PTL 1: Japanese Laid-Open Patent Application Publication No. 2012-62653

SUMMARY OF INVENTION

Technical Problem

According to the drive control system of PTL 1, when turning the revolving super structure, the electric motor keeps on driving at the maximum torque from when the turning of the revolving super structure is started until when the electric power stored in the capacitor runs out. The torque which cannot be obtained from the electric motor is obtained from the oil-pressure motor. However, when the electric motor drives at the maximum torque, the electric power efficiency is low. If the electric motor keeps on driving in such a state, the electric power stored in a capacitor immediately runs short, and the electric motor stops driving. In this case, a drive time of only the oil-pressure motor becomes long, and as a result, an effect of reducing energy necessary to drive the oil-pressure motor decreases.

An object of the present invention is to provide a drive control system of an operating machine, the drive control system being capable of further reducing energy necessary to drive a liquid-pressure motor.

Solution to Problem

A drive control system of an operating machine of the present invention includes: a power storage device storing electric power; an electric motor supplied with the electric power from the power storage device to operate and turn a structure of the operating machine; an electric motor driving device configured to adjust the electric power supplied from the power storage device to the electric motor and drive the electric motor at torque corresponding to the supplied electric power; a liquid-pressure motor supplied with an operating liquid to operate and turn the structure in cooperation with the electric motor; an operating liquid supply device configured to adjust a flow rate and liquid pressure of the operating liquid flowing through the liquid-pressure motor and drive the liquid-pressure motor at torque corresponding to the flow rate and liquid pressure of the supplied operating liquid; an input device by which a target turning speed of the structure is input; and a drive control device configured to determine a target torque for accelerating the structure to the target turning speed and control an operation of the electric motor driving device and an operation of the operating liquid supply device such that a sum of the torque of the electric motor and the torque of the liquid-pressure motor becomes the target torque, wherein: when accelerating the structure to the target turning speed, the drive control device controls the operation of the electric motor driving device such that the electric motor drives at high efficiency torque by which a highest electric power efficiency is obtained at each of rotating speeds of the electric motor before the speed of the structure reaches the target turning speed; and the drive control device controls the operation of the operating liquid supply device such that residual torque obtained by subtracting the high efficiency torque from the target torque is output from the liquid-pressure motor.

According to the present invention, the electric motor can be caused to operate with a high electric power efficiency. Therefore, the use amount of electric power of the power storage device when driving the electric motor can be suppressed. With this, the drive time of the electric motor when accelerating the structure can be made longer than that of the conventional art, and consumption energy necessary to drive the liquid-pressure motor used as the assistance can be further reduced.

In the above invention, it is preferable that: the drive control device store an iso efficiency curve regarding the torque and the rotating speed, the iso efficiency curve being set based on the electric motor and the electric motor driving device; the drive control device further store the high efficiency torque that is torque at a contact point between the rotating speed before the speed of the structure reaches the target turning speed and the iso efficiency curve by which the highest efficiency is obtained with respect to the rotating speed; and the drive control device control the operation of the electric motor driving device such that the electric motor drives at the high efficiency torque.

According to the above configuration, the electric motor is controlled to drive at the high efficiency torque based on the iso efficiency curve of the electric power efficiencies each indicating a ratio of output mechanical energy (rotating speed×torque) to electric energy (electric power=current× voltage) consumed by the electric motor and the electric motor driving device. Therefore, the use amount of electric power of the power storage device when driving the electric motor can be suppressed. With this, the drive time of the electric motor when accelerating the structure can be made longer than that of the conventional art.

In the above invention, it is preferable that: the electric motor be an AC motor which is supplied with an alternating current to drive; the power storage device discharge a direct current; the electric motor driving device convert the direct current, discharged from the power storage device, into the alternating current to supply the alternating current to the electric motor; and the drive control device control the operation of the electric motor driving device such that the electric motor drives at the high efficiency torque by which the highest electric power efficiency is obtained regarding the electric power consumed by the electric motor and the electric motor driving device.

According to the above configuration, since the high efficiency torque is determined also in consideration of the power consumption of the electric motor driving device, the use amount of electric power of the power storage device can be further suppressed. With this, the drive time of the electric motor when accelerating the structure can be made further longer, and the consumption energy necessary to drive the liquid-pressure motor used as the assistance can be further reduced.

In the above invention, it is preferable that: the high efficiency torque of the electric motor be substantially equal to predetermined torque in a predetermined speed range; and in a case where the rotating speed before the speed of the structure reaches the target turning speed falls within the predetermined range, the drive control device calculate the high efficiency torque as the predetermined torque.

According to the above configuration, it becomes unnecessary to control the output torque of the electric motor in accordance with an increase or decrease of the target turning speed. Therefore, the control of the drive control device can be prevented from becoming complex.

In the above invention, it is preferable that: the electric motor have a power generating function of converting kinetic energy of the turning structure into the electric power to reduce the speed of the structure; and the electric motor driving device supply the electric power, converted by the electric motor, to the power storage device to store the electric power in the power storage device.

According to the above configuration, the kinetic energy of the structure which is turning can be recovered as the electric power, and the recovered electric power can be utilized when turning the structure. Such a regeneration operation cannot realize that the entire energy of the structure immediately before the deceleration is recovered, and the recovered energy is utilized in the next powering operation. That is, the electric power which can be utilized in the powering operation is limited. According to the present invention, the electric motor can drive for a long period of time by suppressing the use amount of electric power of the power storage device as described above. Thus, the limited electric power obtained by the regeneration operation can be effectively utilized. Therefore, the present invention can be especially effectively used in the drive control system having the regeneration function.

An operating machine of the present invention includes any one of the above drive control systems.

The present invention can provide an operating machine having the above functions.

A drive control method of an operating machine of the present invention is a drive control method of an operating machine configured to cause an electric motor and a liquid-pressure motor to cooperate with each other to turn a structure of the operating machine, the electric motor being configured to operate in accordance with electric power supplied from a power storage device through an electric motor driving device, the liquid-pressure motor being configured to operate in accordance with a flow rate and liquid pressure of an operating liquid supplied from an operating liquid supply device, the drive control method including: a target torque calculating step of calculating a target torque for accelerating the structure to a target turning speed input by an input device; an electric power supply operation control step of controlling the electric power supplied from the electric motor driving device to the electric motor such that the electric motor drives at high efficiency torque by which a highest electric power efficiency is obtained at each of rotating speeds before the speed of the structure reaches the target turning speed; and an operating liquid supply operation control step of controlling an amount of operating liquid supplied from the operating liquid supply device such that residual torque obtained by subtracting the high efficiency torque from the target torque is output from the liquid-pressure motor.

According to the present invention, the electric motor can be caused to operate with the high electric power efficiency. Therefore, the use amount of electric power of the power storage device when driving the electric motor can be suppressed. With this, the drive time of the electric motor when accelerating the structure can be made longer than that of the conventional art, and the consumption energy necessary to drive the liquid-pressure motor used as the assistance can be further reduced.

The above object, other objects, features, and advantages of the present invention will be made clear by the following detailed explanation of preferred embodiments with reference to the attached drawings.

Advantageous Effects of Invention

The present invention can further reduce the energy necessary to drive the oil-pressure motor.

DESCRIPTION OF EMBODIMENTS

Hereinafter, the configuration of a drive control system 1 according to an embodiment of the present invention and the configuration of a hydraulic excavator 2 including the drive control system 1 will be explained in reference to the drawings. Directions stated in the embodiments are used for convenience of explanation, and the arrangement, directions, and the like of components in the drive control system 1 and the hydraulic excavator 2 are not limited. The configuration of the drive control system 1 and the configuration of the hydraulic excavator 2 explained below are just embodiments of the present invention, and the present invention is not limited to the embodiments. Additions, deletions, and modifications may be made within the scope of the present invention.

Hydraulic Excavator

Figure 1:
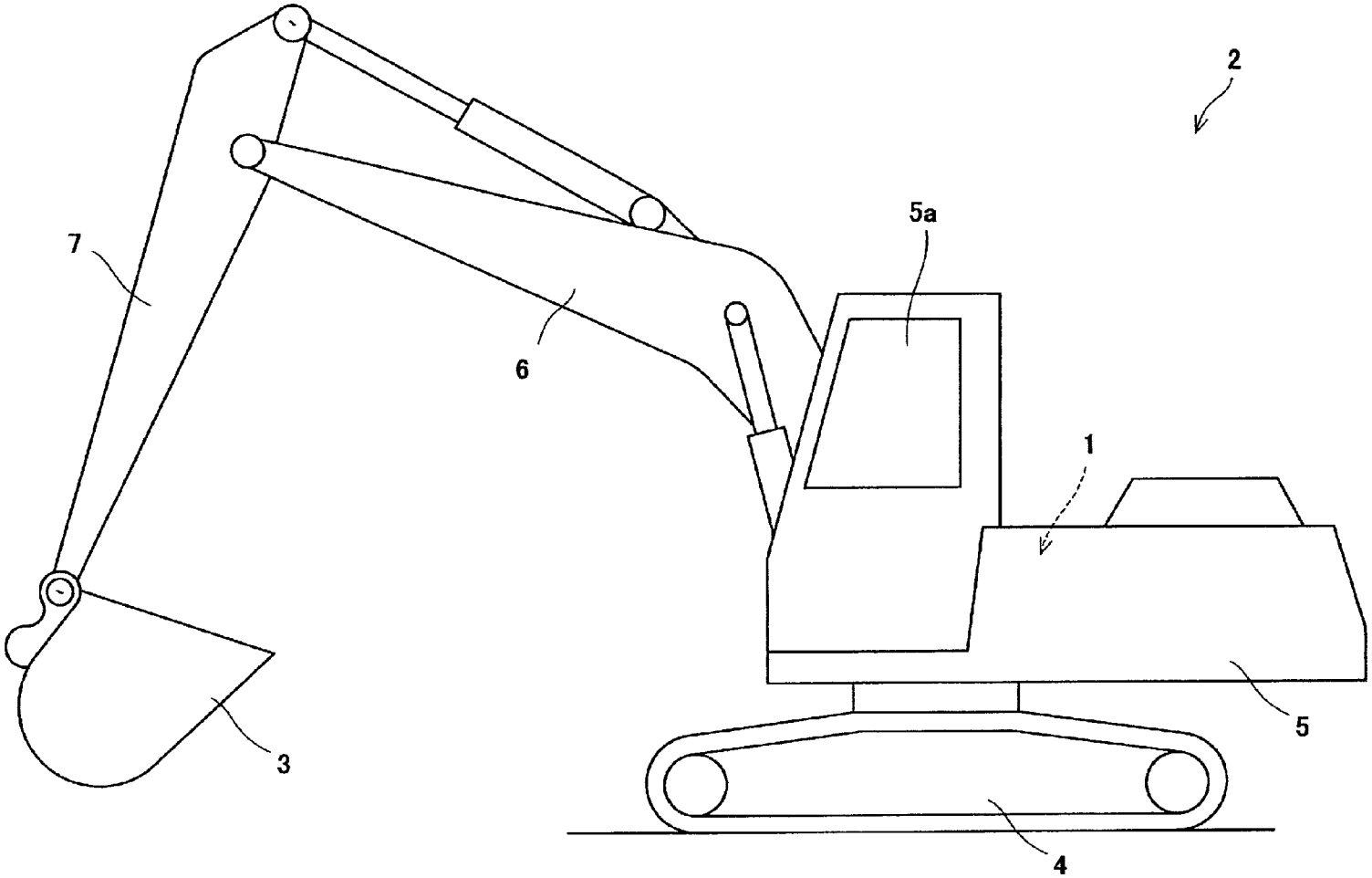
FIG. 1 is a side view showing a hydraulic excavator including a drive control system according to an embodiment of the present invention.
Figure 2:
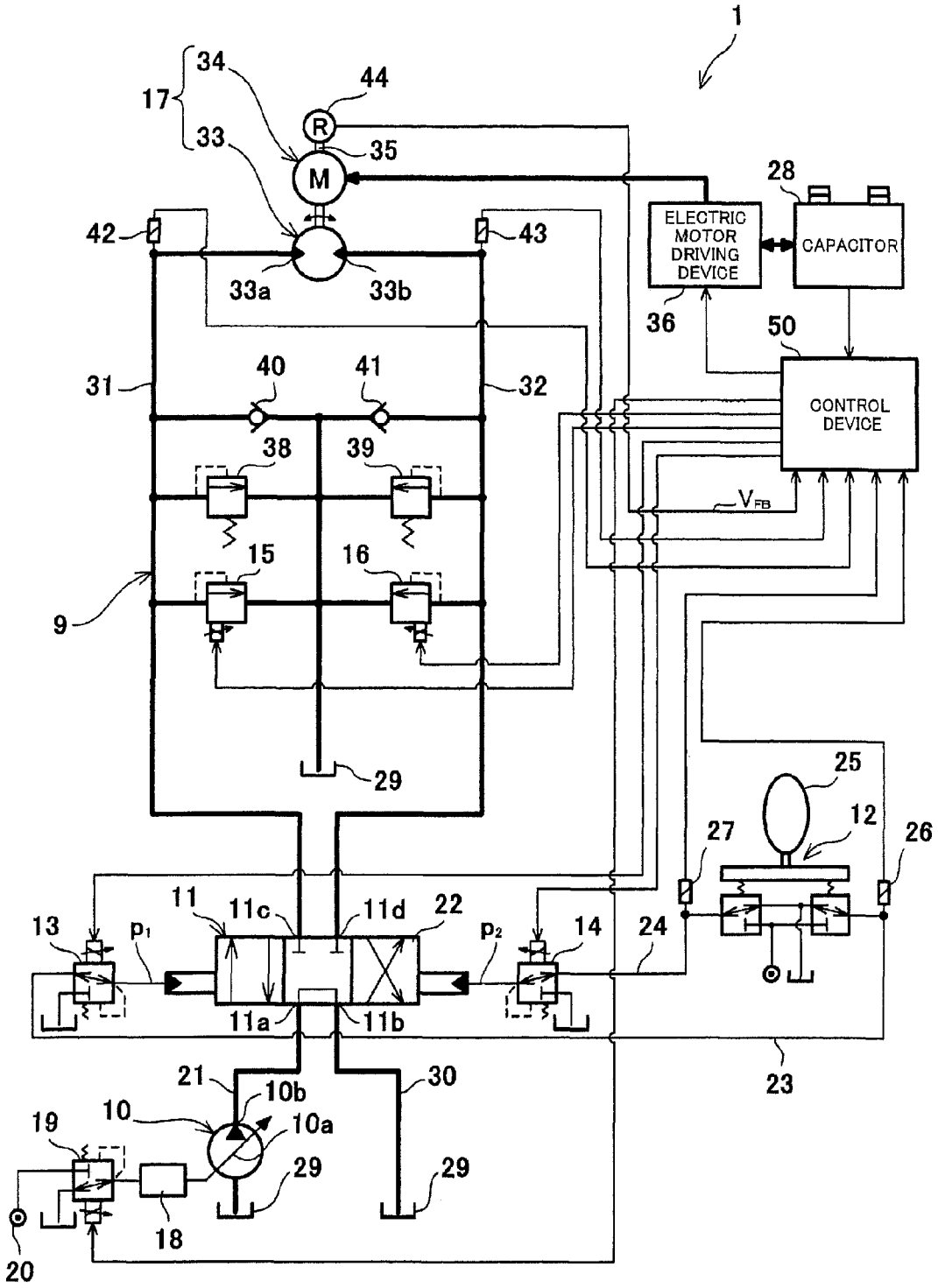
FIG. 2 is an oil-pressure circuit diagram showing an oil-pressure circuit of the drive control system included in the hydraulic excavator of FIG. 1.
Figure 3:
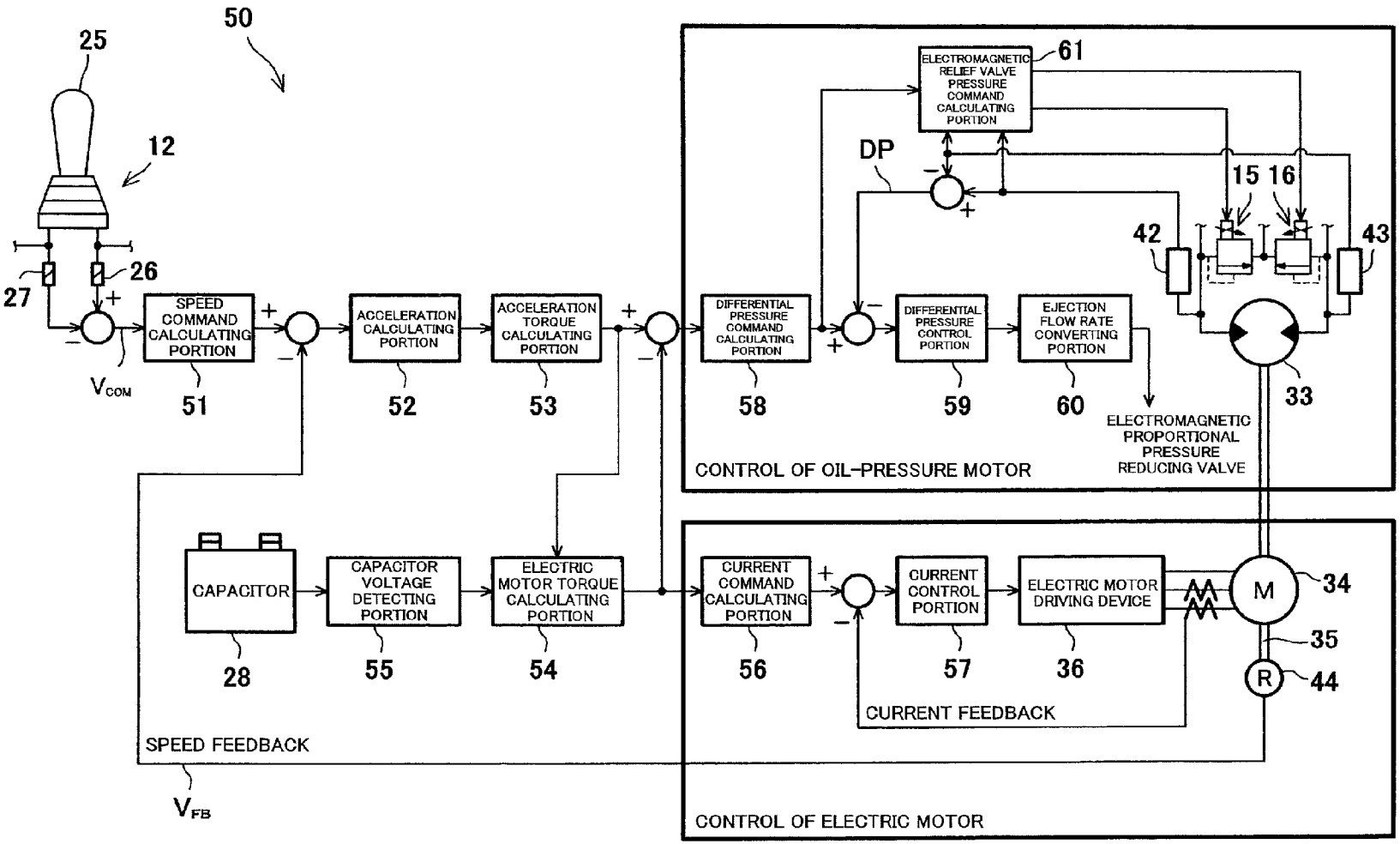
FIG. 3 is a block diagram showing control blocks constituting a control device included in the drive control system of FIG. 2.

As shown in FIG. 1, the hydraulic excavator 2 that is an operating machine can perform various work, such as excavation and carriage, by an attachment such as a bucket 3 attached to a tip end portion of the hydraulic excavator 2. The hydraulic excavator 2 includes a travelling device 4, such as a crawler. A turning body 5 is placed on the travelling device 4. A driver's seat 5*a* in which a driver gets is formed at the turning body 5 that is a structure. The turning body 5 is further provided with the bucket 3 via a boom 6 and an arm 7. The turning body 5 configured as above is configured to be able to turn relative to the travelling device 4. The hydraulic excavator 2 includes the drive control system 1 which turns the turning body 5 and is located in the turning body 5. Hereinafter, the configuration of the drive control system 1 will be explained in reference to FIGS. 2 and 3.

Drive Control System

The drive control system 1 mainly includes an oil-pressure pump 10, a control valve 11, a remote control valve 12, two electromagnetic pressure reducing valves 13 and 14, two electromagnetic relief valves 15 and 16, and an electrohydraulic swing motor 17. The oil-pressure pump 10 that is a liquid-pressure pump is a variable displacement swash plate type oil-pressure pump. The oil-pressure pump 10 is driven by an engine (not shown) to discharge operating oil. The oil-pressure pump 10 includes a swash plate 10*a*. By tilting the swash plate 10*a*, the amount of operating oil discharged can be changed. The swash plate 10*a* is provided with a regulator 18.

The regulator 18 includes a servo piston (not shown). The servo piston is coupled to the swash plate 10*a*. The swash plate 10*a* tilts at a tilting angle corresponding to a position of the servo piston. The regulator 18 is connected to a pilot pump 20 through an electromagnetic proportional pressure reducing valve 19. The electromagnetic proportional pressure reducing valve 19 reduces oil pressure, output from the pilot pump 20, to command pressure $p_0$ corresponding to a command signal transmitted to the electromagnetic proportional pressure reducing valve 19. The command pressure $p_0$ is applied to the regulator 18, and the servo piston moves to a position corresponding to the command pressure $p_0$. To be specific, the swash plate 10*a* tilts at the tilting angle corresponding to the command signal transmitted to the electromagnetic proportional pressure reducing valve 19. The oil-pressure pump 10 whose tilting angle has been changed as above discharges the operating oil through an outlet port 10*b* at a flow rate corresponding to the tilting angle. The control valve 11 is connected to the outlet port 10*b* through an discharge passage 21.

The control valve 11 includes a spool 22. By moving the spool 22, a connection destination of the oil-pressure pump 10 and the flow rate of the operating oil flowing through the connection destination can be changed. Two pilot passages 23 and 24 are connected to the control valve 11, and the remote control valve 12 is connected to the control valve 11 through the pilot passages 23 and 24.

The remote control valve 12 is an input device to which a target turning speed is input. The remote control valve 12 includes an operating lever 25. The operating lever 25 can incline toward one side and the other side in a predetermined direction. The remote control valve 12 outputs pilot oil to the pilot passage 23 or 24 corresponding to an inclination direction of the operating lever 25, the pilot oil having pressure corresponding to an inclination amount (operation amount) of the operating lever 25. Pilot pressure sensors 26 and 27 are connected to the pilot passages 23 and 24, respectively. The electromagnetic pressure reducing valves 13 and 14 are disposed on the pilot passages 23 and 24, respectively. Each of the pilot pressure sensors 26 and 27 detects the oil pressure output from the remote control valve 12. The electromagnetic pressure reducing valves 13 and 14 are so-called normally open pressure reducing valves. The electromagnetic pressure reducing valve 13 can reduce and adjust the pressure of the pilot oil, output from the remote control valve 12, to pressure corresponding to a current (command value) flowing through the electromagnetic pressure reducing valve 13, and the electromagnetic pressure reducing valve 14 can reduce and adjust the pressure of the pilot oil, output from the remote control valve 12, to pressure corresponding to a current (command value) flowing through the electromagnetic pressure reducing valve 14.

The pilot oil output from the remote control valve 12 is introduced to both end portions of the spool 22 through the pilot passages 23 and 24. The spool 22 receives pilot pressure $p_1$ and pilot pressure $p_2$ which are oil pressure of the pilot oil introduced to both end portions of the spool 22. The spool 22 moves to a position corresponding to the pilot pressure $p_1$ and the pilot pressure $p_2$. By the movement of the spool 22, the control valve 11 changes the connection destination of the oil-pressure pump 10 and the flow rate of the operating oil flowing through the connection destination.

The configuration of the control valve 11 will be specifically explained. The control valve 11 includes four ports 11*a* to 11*d*. The first port 11*a* is connected to the oil-pressure pump 10 through the discharge passage 21. The second port 11*b* is connected to a tank 29 through a tank passage 30. The third port 11*c* is connected to the electrohydraulic swing motor 17 through a first oil passage 31, and the fourth port 11*d* is connected to the electrohydraulic swing motor 17 through a second oil passage 32. The connection destination of each of these four ports 11*a* to 11*d* changes in accordance with the position of the spool 22.

More specifically, when the spool 22 is located at a neutral position M1, the first port 11*a* and the second port 11*b* are connected to each other, and the oil-pressure pump 10 becomes an unload state. When the spool 22 moves to a first offset position A1, the first port 11*a* and the third port 11*c* are connected to each other, and the second port 11*b* and the fourth port 11*d* are connected to each other. When the spool 22 moves to a second offset position A2, the first port 11*a* and the fourth port 11*d* are connected to each other, and the second port 11*b* and the third port 11*c* are connected to each other. When the spool 22 is located at the first or second offset position, the oil-pressure pump 10 and the electrohydraulic swing motor 17 are connected to each other, and the operating oil is supplied to the electrohydraulic swing motor 17.

The electrohydraulic swing motor 17 includes an oil-pressure motor 33, an electric motor 34, and an output shaft 35. The output shaft 35 is connected to the turning body 5 through a reducer (not shown). By rotating the output shaft 35, the turning body 5 turns. The oil-pressure motor 33 and the electric motor 34 are configured integrally and cooperate with each other to rotate the output shaft 35. Hereinafter, the configuration of the oil-pressure motor 33 and the configuration of the electric motor 34 will be explained in detail.

The electric motor 34 is, for example, a three-phase AC motor and includes a stator and a rotor (both not shown). The rotor is provided so as not to be rotatable relative to the output shaft 35, and the stator is provided so as not to be rotatable relative to the oil-pressure motor 33. The rotor and the stator are configured so as to be rotatable relative to each other. By supplying a three-phase alternating current (hereinafter may be simply referred to as an "alternating current") to a coil of the stator, the output shaft 35 is rotated normally or reversely at a rotating speed corresponding to a frequency of the alternating current. The electric motor 34 has a power generating function of converting rotational energy of the output shaft 35 into electric energy to generate the alternating current. By the power generation, the rotating output shaft 35 is decelerated.

The electric motor 34 configured as above is electrically connected to an electric motor driving device 36 and is further electrically connected to a capacitor 28 through the electric motor driving device 36.

The electric motor driving device 36 is a device constituted by a combination of an inverter and a chopper. The capacitor 28 can store electric power and discharges a direct current to the electric motor driving device 36. The electric motor driving device 36 converts the direct current, discharged from the capacitor 28, into the alternating current to supply the alternating current to the electric motor 34. The electric motor driving device 36 converts the alternating current, generated by the electric motor 34, into the direct current to output the direct current to the capacitor 28. The capacitor 28 stores the direct current output from the electric motor driving device 36. The electric motor driving device 36 has a frequency adjusting function of adjusting the frequency of the alternating current, supplied to the electric motor 34, to the frequency corresponding to the command value. By adjusting the frequency of the alternating current, the revolution of the output shaft 35 is changed.

The oil-pressure motor 33 is, for example, a fixed displacement swash plate type oil-pressure motor and includes two supplying/discharging ports 33*a* and 33*b*. The first oil passage 31 is connected to the first supplying/discharging port 33*a*, and the second oil passage 32 is connected to the second supplying/discharging port 33*b*. When the operating oil is supplied to the first supplying/discharging port 33*a* of the oil-pressure motor 33, the oil-pressure motor 33 rotates the output shaft 35 in a forward direction at the rotating speed corresponding to the flow rate of the operating oil. When the operating oil is supplied to the second supplying/discharging port 33*b* of the oil-pressure motor 33, the oil-pressure motor 33 rotates the output shaft 35 in a backward direction at the rotating speed corresponding to the flow rate of the operating oil.

The oil-pressure motor 33 configured as above is supplied with the operating oil by an operating oil supply device 9. With this, the oil-pressure motor 33 generates the assist torque which assists the rotation of the output shaft 35. The operating oil supply device 9 is mainly constituted by the oil-pressure pump 10, the control valve 11, the electromagnetic pressure reducing valves 13 and 14, and the electromagnetic relief valves 15 and 16. The electromagnetic relief valves 15 and 16 are connected to the first oil passage 31 and the second oil passage 32, respectively, and are further connected to the tank 29. The electromagnetic relief valve 15 has a pressure adjusting function of discharging the operating oil of the oil passage 31 to the tank 29 to adjust the oil pressure of the operating oil to the pressure corresponding to the current (command value) flowing through the electromagnetic relief valve 15, and the electromagnetic relief valve 16 has a pressure adjusting function of discharging the operating oil of the oil passage 32 to the tank 29 to adjust the oil pressure of the operating oil to the pressure corresponding to the current (command value) flowing through the electromagnetic relief valve 16. According to the operating oil supply device 9, the rotation of the output shaft 35 can be decelerated by adjusting the oil pressure of the operating oil of the discharge-side oil passage 31 or 32 by the electromagnetic relief valve 15 or 16. In addition, the assist torque of the oil-pressure motor 33 can be adjusted by adjusting the pressure of the operating oil of the supply-side oil passage 31 or 32 by the electromagnetic relief valve 15 or 16.

The operating oil supply device 9 includes relief valves 38 and 39 and check valves 40 and 41. The relief valve 38 and the check valve 40 are connected to the first oil passage 31, and the relief valve 39 and the check valve 41 are connected to the second oil passage 32. The relief valve 38 opens the oil passage 31 to the tank 29 when the pressure of the operating oil flowing through the oil passage 31 exceeds a service pressure limit, and the relief valve 39 opens the oil passage 32 to the tank 29 when the pressure of the operating oil flowing through the oil passage 32 exceeds the service pressure limit. By opening the oil passage 31 or 32, damages on the drive control system 1 are suppressed. The check valves 40 and 41 are connected to the tank 29. The check valve 40 allows the flow of the operating oil from the tank 29 to the oil passage 31 and blocks the reverse flow of the operating oil, and the check valve 41 allows the flow of the operating oil from the tank 29 to the oil passage 32 and blocks the reverse flow of the operating oil. With this, the shortage of the operating oil which is necessary when driving the oil-pressure motor 33 can be introduced from the tank 29 through the check valves 40 and 41 to the oil-pressure motor 33.

Further, oil pressure sensors 42 and 43 are provided at the first oil passage 31 and the second oil passage 32, respectively. Oil pressure supplied to the supplying/discharging port 33*a* of the oil-pressure motor 33 and oil pressure supplied to the supplying/discharging port 33*b* of the oil-pressure motor 33 are detected by the oil pressure sensors 42 and 43, respectively. A revolution sensor 44 is provided at the output shaft 35 of the electrohydraulic swing motor 17. The revolution sensor 44 detects the revolution of the output shaft 35 (i.e., the rotating speed of the output shaft 35). The sensors 42 to 44 and the pilot pressure sensors 26 and 27 are electrically connected to a control device 50 which controls various components. The sensors 42 to 44 and the pilot pressure sensors 26 and 27 transmit detected values to the control device 50. Specifically, the oil pressure detected by the oil pressure sensor 42 and the oil pressure detected by the oil pressure sensor 43 are input to the control device 50, and differential pressure between the oil pressure detected by the oil pressure sensor 42 and the oil pressure detected by the oil pressure sensor 43 becomes a differential pressure feedback signal DP. The pilot pressure detected by the pilot pressure sensor 26 and the pilot pressure detected by the pilot pressure sensor 27 are input to the control device 50, and differential pressure between the pilot pressure detected by the pilot pressure sensor 26 and the pilot pressure detected by the pilot pressure sensor 27 becomes a speed command signal $V_{COM}$. The revolution detected by the revolution sensor 44 is input to the control device 50 and becomes a speed feedback signal $V_{FB}$.

The control device 50 is electrically connected to the electromagnetic pressure reducing valves 13 and 14, the electromagnetic relief valves 15 and 16, the electromagnetic proportional pressure reducing valve 19, and the electric motor driving device 36. The control device 50 supplies command values, corresponding to various signals from the sensors 26, 27, and 42 to 44, to the valves 13 to 16 and 19 and the electric motor driving device 36 to control the operations of the valves 13 to 16 and 19 and electric motor driving device 36. By controlling the operations of the valves 13 to 16 and 19 and electric motor driving device 36, the operating oil supply device 9 and the electric motor 34 are driven, and the turning body 5 turns to perform a desired operation. Hereinafter, control blocks of the control device 50 will be specifically explained in reference to FIG. 3.

Control Block of Control Device

The control device 50 includes a speed command calculating portion 51, an acceleration calculating portion 52, an acceleration torque calculating portion 53, an electric motor torque calculating portion 54, a capacitor voltage detecting portion 55, a current command calculating portion 56, a current control portion 57, a differential pressure command calculating portion 58, a differential pressure control portion 59, and an discharge flow rate converting portion 60. The speed command signal $V_{COM}$ that is a signal indicating the target turning speed is input to the speed command calculating portion 51, and the speed command calculating portion 51 calculates a speed command value based on the speed command signal $V_{COM}$. The speed command value is a command value indicating the target turning speed of the turning body 5 and corresponding to the inclination amount of the operating lever. The speed command calculating portion 51 outputs the calculated speed command value to the acceleration calculating portion 52. A speed difference obtained by subtracting the speed feedback signal $V_{FB}$ (the actual rotating speed of the output shaft 35) from the speed command value is input to the acceleration calculating portion 52.

The acceleration calculating portion 52 calculates the acceleration of the output shaft 35 based on the input speed difference. To be specific, the acceleration calculating portion 52 calculates the acceleration of the output shaft 35 such that the turning speed of the turning body 5 becomes target revolution. The acceleration calculating portion 52 inputs the calculated acceleration to the acceleration torque calculating portion 53. Based on the calculated acceleration, the acceleration torque calculating portion 53 calculates target acceleration torque necessary to accelerate the output shaft 35. The acceleration torque calculating portion 53 outputs the target acceleration torque to the electric motor torque calculating portion 54 and the differential pressure command calculating portion 58.

In addition to the target acceleration torque, the electric motor torque calculating portion 54 receives a voltage value from the capacitor voltage detecting portion 55. The capacitor voltage detecting portion 55 is electrically connected to the capacitor 28 and detects a voltage of the capacitor 28 (i.e., the amount of electric power stored in the capacitor 28). The capacitor voltage detecting portion 55 outputs the detected voltage to the electric motor torque calculating portion 54. The electric motor torque calculating portion 54 calculates target torque of the electric motor 34 based on the received voltage and the target acceleration torque. This calculation method will be described later in detail. The electric motor torque calculating portion 54 outputs the calculated target torque of the electric motor 34 to the current command calculating portion 56 and the differential pressure command calculating portion 58.

Setting of the target torque of the electric motor 34 is not limited to the above embodiment. To set the torque of the electric motor to high efficiency torque, the target torque of the electric motor 34 may be determined in such a manner that: the target torque of the oil-pressure motor 33 is determined based on the target acceleration torque; and the target torque of the oil-pressure motor 33 is subtracted from the target acceleration torque.

The current command calculating portion 56 calculates a target current necessary to output the calculated target torque of the electric motor 34 and outputs the target current to the current control portion 57. An actual current actually supplied from the electric motor driving device 36 to the electric motor 34 is fed back to the current control portion 57. To be specific, a subtraction result obtained by subtracting the actual current from the target current calculated by the current command calculating portion 56 is input to the current control portion 57. The current control portion 57 controls the electric motor driving device 36 based on the subtraction result to cause the electric motor 34 to output the target torque.

On the other hand, the target torque of the oil-pressure motor 33 obtained by subtracting the target torque of the electric motor 34 from the target acceleration torque is input to the differential pressure command calculating portion 58. Based on the target torque of the oil-pressure motor 33, the differential pressure command calculating portion 58 calculates a target supplying/discharging differential pressure between the supplying/discharging ports 33*a* and 33*b* of the oil-pressure motor 33. The differential pressure command calculating portion 58 outputs the target supplying/discharging differential pressure to the differential pressure control portion 59. A differential value obtained by subtracting the differential pressure feedback signal DP from the target supplying/discharging differential pressure is input to the differential pressure control portion 59. Based on the differential value, the differential pressure control portion 59 calculates an increased/decreased flow rate by which a present discharge flow rate of the oil-pressure pump 10 is increased or decreased. The differential pressure control portion 59 outputs the increased/decreased flow rate to the discharge flow rate converting portion 60. Based on the increased/decreased flow rate calculated by the differential pressure control portion 59, the discharge flow rate converting portion 60 calculates the command pressure $p_0$ which is to be output from the electromagnetic proportional pressure reducing valve 19. The discharge flow rate converting portion 60 outputs to the electromagnetic proportional pressure reducing valve 19*a* command pressure signal corresponding to the command pressure $p_0$.

The control device 50 including the control blocks 51 to 60 controls the operation of the electrohydraulic swing motor 17 so as to cause the electric motor 34 and the oil-pressure motor 33 to cooperate with each other. The control device 50 increases the turning speed of the turning body 5 to the target turning speed corresponding to the inclination amount of the operating lever. Specifically, the control device 50 drives the output shaft 35 mainly by the electric motor 34. In a case where the output torque of the electric motor 34 cannot satisfy the calculated target acceleration torque, the torque shortage is compensated by the assist torque of the oil-pressure motor 33. Hereinafter, a control operation of the control device 50 will be explained in more detail.

Control Operation of Control Device

First, the pilot pressure detected by the pilot pressure sensor 26 and the pilot pressure detected by the pilot pressure sensor 27 are input to the control device 50. In the present embodiment, when the operating lever 25 is inclined, the pilot oil is output to only one of the pilot passages 23 and 24. Therefore, the pilot pressure detected by one of the pilot pressure sensors 26 and 27 is input to the control device 50. In the control device 50, the speed command calculating portion 51, the acceleration calculating portion 52, and the acceleration torque calculating portion 53 calculate the target acceleration torque based on the speed feedback signal $V_{FB}$ and the speed command signal $V_{COM}$ that is a differential pressure value between the pilot pressure detected by the pilot pressure sensor 26 and the pilot pressure detected by the pilot pressure sensor 27, and the target acceleration torque is output to the electric motor torque calculating portion 54.

The electric motor torque calculating portion 54 calculates the target torque of the electric motor 34 based on the target acceleration torque and the voltage of the capacitor 28 detected by the capacitor voltage detecting portion 55. In this calculation, the high efficiency torque by which the efficiency of the electric motor 34 becomes the highest with respect to the rotating speed of the output shaft 35 is calculated (set) as the target torque output from the electric motor 34. Hereinafter, a method of calculating the target torque of the electric motor 34 will be explained below in detail. First, an iso efficiency curve of electric power efficiencies will be explained in reference to FIG. 4, each of the electric power efficiencies indicating a ratio of output mechanical energy (rotating speed×torque) to electric energy (electric power=current×voltage) consumed by the electric motor 34 and the electric motor driving device 36. Then, the method of calculating the target torque of the electric motor 34 will be explained in more detail.

Figure 4:
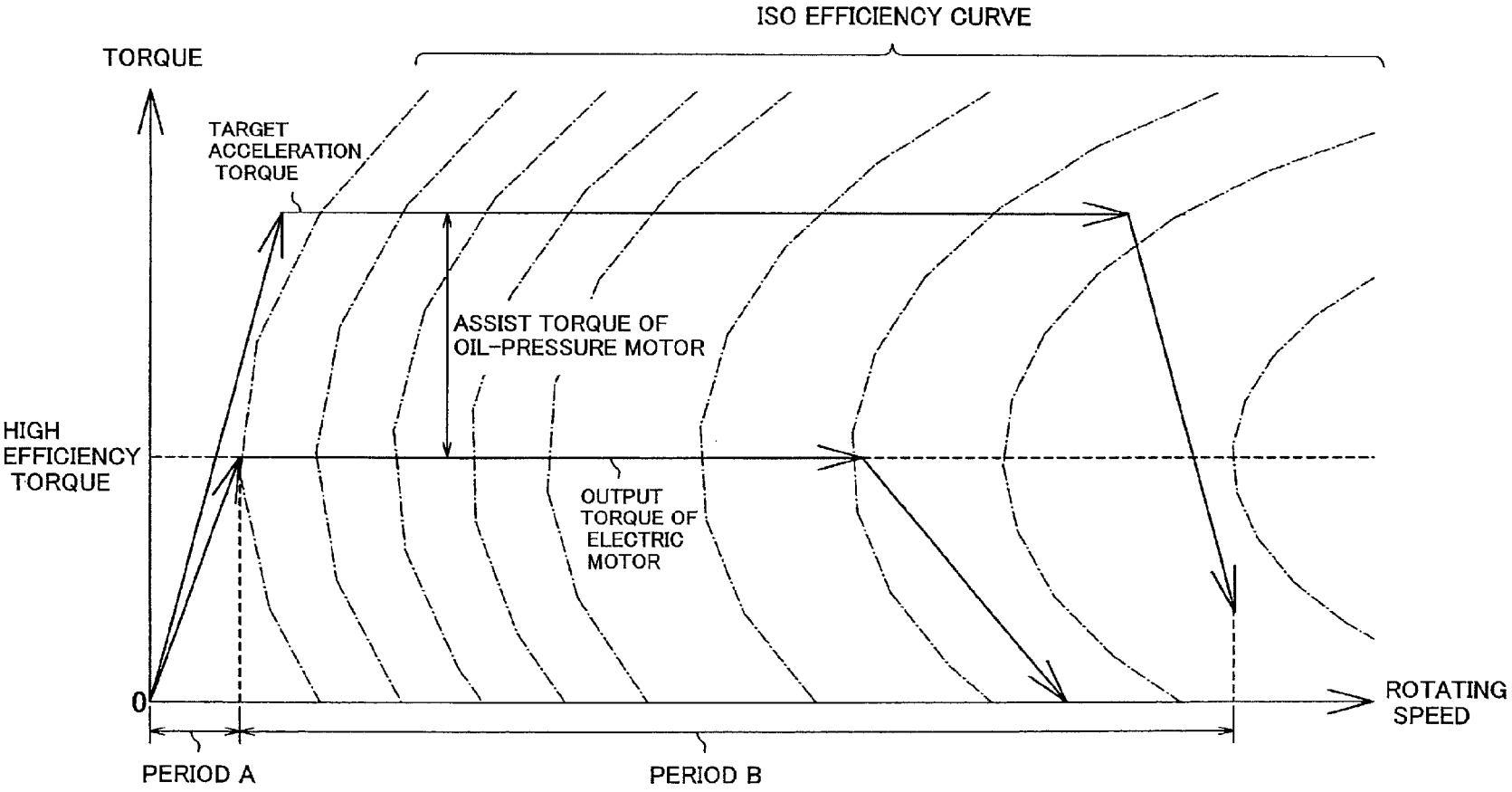
FIG. 4 is a graph showing iso efficiency curves of an electric motor included in the drive control system of FIG. 2.

In a graph of FIG. 4, a vertical axis denotes torque, and a horizontal axis denotes a rotating speed. In addition, a plurality of curved dashed lines denote the iso efficiency curves. The iso efficiency curve is a line connecting points which are the same in the electric power efficiency (torque× rotating speed/electric power) as each other in the graph of the torque and the rotating speed shown in FIG. 4. Even when the electric motor 34 is driven at the torque and rotating speed of any point on the iso efficiency curve of FIG. 4, each of the electric motor 34 and the electric motor driving device 36 drives at a constant electric power efficiency. The electric power efficiency of the electric motor 34 and the electric power efficiency of the electric motor driving device 36 increase as the rotating speed increases. After the rotating speed reaches a predetermined rotating speed (not shown), the electric power efficiency of the electric motor 34 and the electric power efficiency of the electric motor driving device 36 decrease as the rotating speed increases. The efficiency curves at a right side on the sheet of FIG. 4 show higher electric power efficiencies.

The high efficiency torque by which the electric power efficiency becomes the highest with respect to an arbitrary rotating speed of the output shaft 35 is calculated based on the graph of FIG. 4. The electric motor torque calculating portion 54 stores the high efficiency torque such that the high efficiency torque is associated with each rotating speed. The electric motor torque calculating portion 54 calculates the target torque of the electric motor 34 based on the high efficiency torque. To be specific, the control device 50 stores the iso efficiency curve of the electric power efficiencies regarding the torque and the rotating speed, the iso efficiency curve being set based on the electric motor 34 and the electric motor driving device 36, and further stores the high efficiency torque that is torque at a contact point between a straight line indicating each rotating speed before the turning speed of the turning body 5 reaches the target turning speed and the iso efficiency curve whose efficiency is the highest with respect to the rotating speed. The control device 50 controls the operation of the electric motor driving device 36 such that the electric motor 34 drives at the high efficiency torque. In the present embodiment, as shown FIG. 4, the high efficiency torque of the electric motor 34 in a certain turning speed (rotating speed) range is a substantially constant value. Therefore, when the target acceleration torque is not less than the high efficiency torque (period B in FIG. 4), the target torque of the electric motor 34 is set to the high efficiency torque. On the other hand, when the target acceleration torque is less than the high efficiency torque (period A in FIG. 4) such as immediately after the start-up, the target torque of the electric motor 34 is set to torque corresponding to a rate preset with respect to the target acceleration torque.

When the high efficiency torque is not a constant value in accordance with the turning speed unlike the drive control system 1 of the present embodiment, a torque map indicating the correspondence between the turning speed and the high efficiency torque is stored in the electric motor torque calculating portion 54. The electric motor torque calculating portion 54 calculates (sets) the target torque based on the stored torque map, the speed command signal $V_{COM}$, and the speed feedback signal $V_{FB}$.

The electric motor torque calculating portion 54 outputs the calculated (set) target torque of the electric motor 34 to the current command calculating portion 56 and the differential pressure command calculating portion 58. The current command calculating portion 56 calculates the target current in accordance with the target torque of the electric motor 34. The current control portion 57 controls the electric motor driving device 36 based on a subtraction result obtained by subtracting the actual current from the target current. With this, the target torque is output from the electric motor 34.

Simultaneously, the differential pressure command calculating portion 58 calculates the target supplying/discharging differential pressure between the supplying/discharging ports 33*a* and 33*b* of the oil-pressure motor 33 based on the target torque of the oil-pressure motor 33 obtained by subtracting the target torque of the electric motor 34 from the target acceleration torque. The differential pressure feedback signal DP is subtracted from the target supplying/discharging differential pressure, and the differential pressure control portion 59 calculates the discharge flow rate based on the differential value obtained by subtracting the differential pressure feedback signal DP from the target supplying/discharging differential pressure. The discharge flow rate converting portion 60 calculates the command pressure $p_0$ based on the discharge flow rate and outputs the command pressure signal corresponding to the command pressure $p_0$ to the electromagnetic proportional pressure reducing valve 19. With this, the pilot pressure of the command pressure $p_0$ is output from the electromagnetic proportional pressure reducing valve 19, and the swash plate 10*a* of the oil-pressure pump 10 tilts at the tilting angle corresponding to the command pressure $p_0$. By this tilting, the amount of operating oil discharged from the oil-pressure pump 10 is adjusted.

An electromagnetic relief valve pressure command calculating portion 61 outputs an electromagnetic relief valve pressure command based on the target supplying/discharging differential pressure calculated by the differential pressure command calculating portion 58, the pressure of the supplying/discharging port 33*a* of the oil-pressure motor 33, and the pressure of the supplying/discharging port 33*b* of the oil-pressure motor 33. With this, the target torque of the oil-pressure motor 33 is corrected by the electromagnetic relief valves 15 and 16. Therefore, the stable target torque is obtained from the oil-pressure motor 33.

The operating oil discharged from the oil-pressure pump 10 flows through the control valve 11 to be output to the oil passage 31 or 32 corresponding to the inclination direction of the operating lever 25. For example, when the operating lever 25 is inclined toward one side in the predetermined direction, the operating oil from the oil-pressure pump 10 is output to the first oil passage 31. In the control valve 11, the spool 22 moves to a position corresponding to the inclination amount of the operating lever 25 to adjust an opening position between the first port 11*a* and the third port 11*c*. Then, the operating oil is output through the first oil passage 31 to the oil-pressure motor 33 at the flow rate corresponding to the inclination amount of the operating lever 25. Simultaneously, the second oil passage 32 and the tank 29 are connected to each other by the moved spool 22, and the operating oil is discharged from the oil-pressure motor 33 to the tank 29. With this, the target torque is output from the oil-pressure motor 33.

Operations of Drive Control System

Figure 5:
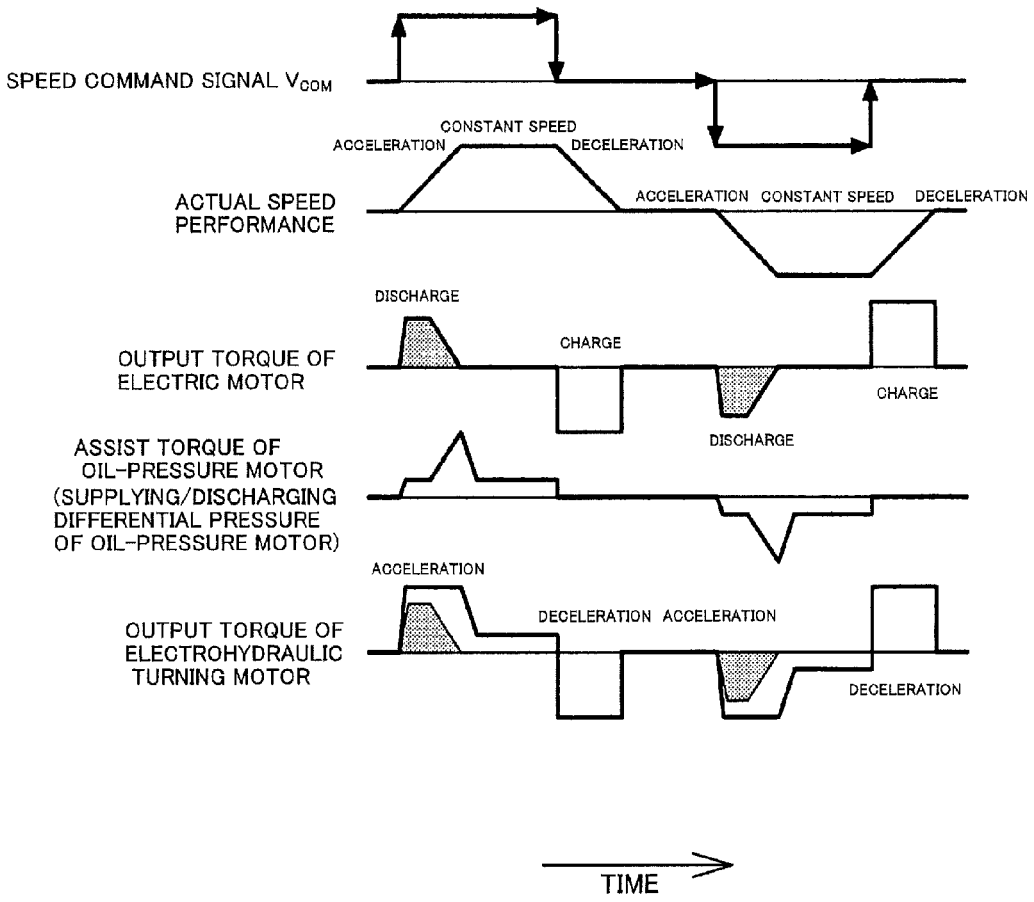
FIG. 5 is a sequence diagram showing a speed command input from an operating lever included in the drive control system of FIG. 2, an actual speed performance of a turning body with respect to the speed command, output torque of an electric motor, assist torque of an oil-pressure motor, and a time-lapse change of output torque of an electrohydraulic swing motor.

Hereinafter, the operations of the drive control system 1 will be explained by using an example in which the operating lever 25 is inclined, and the speed command shown in FIG. 5 is output from the remote control valve 12. First, FIG. 5 will be explained. A sequence diagram of FIG. 5 shows the speed command, the actual speed performance of the turning body 5, the output torque of the electric motor 34, the assist torque of the oil-pressure motor 33, and a time-lapse change of the output torque of the electrohydraulic swing motor 17 in this order from an upper side. In FIG. 5, in a region above a reference axis, the speed command, the speed, and the torque are generated in the forward direction. In a region under the reference axis, the speed command, the speed, and the torque are generated in the backward direction.

When the operating lever 25 is inclined toward one side in the predetermined direction, the pilot pressure detected by the pilot pressure sensor 26 or 27 is input to the control device 50, and the speed command signal $V_{COM}$ is generated. Then, as with the above, the speed command calculating portion 51, the acceleration calculating portion 52, and the acceleration torque calculating portion 53 calculate the target acceleration torque, corresponding to the inclination amount of the operating lever 25, based on the speed difference between the speed command signal $V_{COM}$ and the speed feedback signal $V_{FB}$. Further, the electric motor torque calculating portion 54 and the current command calculating portion 56 calculate the target current, and the current control portion 57 and the electric motor driving device 36 controls the output torque of the electric motor 34 based on the target current and the actual current. Immediately after the start-up, the target acceleration torque corresponding to the inclination amount of the operating lever 25 is lower than the high efficiency torque. Therefore, the control device 50 sets the target torque at the rate preset with respect to the target acceleration torque. Then, the control device 50 drives the electric motor 34 such that the electric motor 34 outputs the target torque.

After that, when the inclination amount of the operating lever 25 is increased, and the target acceleration torque becomes higher than the high efficiency torque, the target torque of the electric motor 34 is set to the high efficiency torque. In this case, to compensate the shortage with respect to the target acceleration torque, the control device 50 increases the discharge amount of the oil-pressure pump 10 so as to assist the rotation of the output shaft 35 by the oil-pressure motor 33. More specifically, the control device 50 calculates a necessary pump discharge flow rate such that the oil-pressure motor 33 outputs the target torque. Thus, the control device 50 controls the discharge flow rate of the oil-pressure pump 10. To be specific, the differential pressure between the supplying/discharging ports 33*a* and 33*b* of the oil-pressure motor 33 is subtracted from the target supplying/discharging differential pressure calculated by the differential pressure command calculating portion 58, and based on the obtained differential value, the differential pressure control portion 59 calculates the discharge flow rate of the oil-pressure pump 10 which is to be increased or decreased. Next, based on the increased or decreased discharge flow rate output from the differential pressure control portion 59, the discharge flow rate converting portion 60 calculates the command pressure $p_0$ which is to be output from the electromagnetic proportional pressure reducing valve 19, and outputs to the electromagnetic proportional pressure reducing valve 19 the command pressure signal corresponding to the command pressure $p_0$. With this, the operating oil is discharged from the oil-pressure pump 10 at a flow rate necessary to output the target torque.

By the above control, the oil-pressure motor 33 can assist the output torque of the electric motor 34, and the target acceleration torque corresponding to the inclination amount of the operating lever 25 can be applied to the output shaft 35 while driving the electric motor 34 and the electric motor driving device 36 with high efficiency. With this, the use amount of electric power of the capacitor 28 when driving the electric motor can be suppressed, and the electric power stored in the capacitor 28 can be efficiently utilized. Therefore, a drive time of the electric motor 34 at the time of the acceleration of the turning body 5 can be made longer than that of the conventional art, and consumption energy of the oil-pressure motor 33 can be further reduced. By reducing the consumption energy of the oil-pressure motor 33, the flow rate of the operating oil supplied to the oil-pressure motor 33 can be reduced. As a result, the fuel efficiency of an engine necessary to drive the oil-pressure pump 10 can be improved, and the energy of the drive control system 1 can be saved.

Since the control device 50 sets the high efficiency torque in consideration of not only the power consumption of the electric motor 34 but also the power consumption of the electric motor driving device 36, the use amount of electric power of the capacitor 28 can be further suppressed. With this, the drive time of the electric motor 34 when accelerating the turning body 5 can be further increased, and the consumption energy of the oil-pressure motor 33 can be further reduced. Further, since the present embodiment adopts the electric motor 34 whose high efficiency torque is substantially constant in a predetermined turning speed range (in the present embodiment, regardless of the turning speed of the turning body 5), it is unnecessary to increase or decrease the output torque of the electric motor 34 in accordance with the increase or decrease of the target turning speed. Therefore, the control of the electric motor driving device 36 can be prevented from becoming complex.

In such a turning/driving operation, as described above, the electric motor 34 mainly drives, and the oil-pressure motor 33 assists the electric motor 34. However, if the turning body 5 keeps on accelerating, the electric power stored in the capacitor 28 decreases, and the voltage lowers. This voltage reduction is detected by the capacitor voltage detecting portion 55. When the voltage lowers, the electric motor torque calculating portion 54 decreases the target torque of the electric motor 34 in accordance with the voltage reduction regardless of the input target acceleration torque. The electric motor torque calculating portion 54 causes the electric motor 34 to output the target torque corresponding to the amount of electric power stored in the capacitor 28.

On the other hand, the differential pressure command calculating portion 58 receives the target torque of the oil-pressure motor 33, the target torque being increased in accordance with the decreased target torque of the electric motor 34. The differential pressure command calculating portion 58, the differential pressure control portion 59, and the discharge flow rate converting portion 60 controls the electromagnetic proportional pressure reducing valve 19 in accordance with the increased target torque to increase the tilting angle of the swash plate 10*a*. With this, the target torque is output from the oil-pressure motor 33, and the target acceleration torque is applied to the output shaft 35 by the oil-pressure motor 33 and the electric motor 34.

Then, when the voltage detected by the capacitor voltage detecting portion 55 becomes not more than a predetermined voltage, the electric motor torque calculating portion 54 determines that the electric motor 34 cannot drive, and sets the target torque of the electric motor 34 to zero. In this case, the entire target acceleration torque needs to be output from the oil-pressure motor 33, and the target torque of the oil-pressure motor 33 input to the differential pressure command calculating portion 58 is set as the target acceleration torque. The differential pressure command calculating portion 58, the differential pressure control portion 59, and the discharge flow rate converting portion 60 controls the electromagnetic proportional pressure reducing valve 19 in accordance with the set target torque to cause the oil-pressure motor 33 to output the target torque. Thus, the output shaft 35 is driven only by the oil-pressure motor 33.

When the turning speed of the turning body 5 gets close to the target turning speed indicated by the speed command signal $V_{COM}$, the target acceleration torque decreases, and the target torque of the oil-pressure motor 33 decreases in accordance with the decrease in the target acceleration torque. In such a case, the differential pressure command calculating portion 58, the differential pressure control portion 59, and the discharge flow rate converting portion 60 controls the electromagnetic proportional pressure reducing valve 19 in accordance with the decreased target torque to decrease the tilting angle of the swash plate 10*a*. With this, the turning speed of the turning body 5 is increased to the target turning speed while decreasing the assist torque of the oil-pressure motor 33. When the turning speed of the turning body 5 reaches the target turning speed, the acceleration calculated by the acceleration calculating portion 52 becomes zero, and the acceleration torque calculating portion 53 calculates the torque necessary for constant-speed turning. With this, the turning body 5 keeps on turning at the target turning speed corresponding to the inclination amount of the operating lever 25.

Then, when the operating lever 25 is returned to the neutral position, all the ports 11*a* to 11*d* are blocked by the control valve 11. At this time, in a drive circuit at the oil-pressure motor 33 side, the control device 50 supplies a current to the electromagnetic relief valve 16 to fully open the electromagnetic relief valve 16. With this, the oil-pressure motor 33 becomes the unload state. On the other hand, the electric motor driving device 36 electrically connects the electric motor 34 and the capacitor 28 with each other. With this, the rotational energy (kinetic energy) of the turning body 5 is converted into the AC power by the electric motor 34, and the control device 50 controls the operation of the electric motor driving device 36 to convert the AC power into the DC power and store the DC power in the capacitor 28. Thus, the electric power can be stored in the capacitor 28 while reducing the speed of the turning body 5.

In a case where the power storage capacity of the capacitor 28 is large, and the entire converted electric power can be stored in the capacitor 28 as in the present embodiment, the electromagnetic relief valve 16 can be fully opened, and the oil-pressure motor 33 can be set to the unload state as described above. In contrast, in a case where the power storage capacity of the capacitor 28 is small, and the entire converted electric power cannot be stored in the capacitor 28, it is preferable that the oil pressure of the operating oil discharged to the tank 29 be adjusted by the electromagnetic relief valve 16, and the speed of the output shaft 35 be decreased by applying the discharge resistance to the oil-pressure motor 33. As above, according to the drive control system 1 in which the speed of the turning body 5 is decreased as above, when the turning body 5 stops, the operation of storing the electric power in the capacitor 28 terminates.

As above, according to the drive control system 1, the kinetic energy of the turning body which is turning can be recovered as the electric power, and the recovered electric power can be utilized when turning the turning body 5. Such a regeneration operation cannot realize that the entire kinetic energy of the turning body 5 immediately before the deceleration is recovered, and the recovered energy is utilized in the next powering operation. That is, the electric power which can be utilized in the powering operation is limited. According to the drive control system 1, the electric motor 34 can drive for a long period of time by suppressing the use amount of electric power of the capacitor 28 as described above. Thus, the limited electric power obtained by the regeneration operation can be effectively utilized. Therefore, the electric power can be especially effectively used in the drive control system 1 having the regeneration function.

The operation of the drive control system 1 when the operating lever 25 is inclined toward the other side in the predetermined direction is the same as the operation of the drive control system 1 when the operating lever 25 is inclined toward one side in the predetermined direction except that the direction of the output torque of the oil-pressure motor 33, the direction of the output torque of the electric motor 34, the direction of the torque generated at the time of the deceleration of the oil-pressure motor 33, and the direction of the torque generated at the time of the deceleration of the electric motor 34 when the operating lever 25 is inclined toward the other side in the predetermined direction are opposite to those when the operating lever 25 is inclined toward one side in the predetermined direction. Therefore, the operation of the drive control system 1 when the operating lever 25 is inclined toward the other side in the predetermined direction can be understood from the explanation of the operation of the drive control system 1 when the operating lever 25 is inclined toward one side in the predetermined direction, so that a detailed explanation thereof is omitted.

Other Embodiments

The drive control system 1 of the present embodiment is a system which adjusts the tilting angle of the swash plate 10*a* by a positive control method. However, the drive control system 1 of the present embodiment may be a system which adjusts the tilting angle of the swash plate 10*a* by a negative control method or a system which adjusts the tilting angle of the swash plate 10*a* by a load sensing method. The oil-pressure pump 10 may be a fixed displacement pump which cannot adjust the tilting angle of the swash plate 10*a*. For example, in this case, the control device 50 adjusts the position of the spool 22 by the electromagnetic pressure reducing valves 13 and 14 and adjusts the oil pressure of the first oil passage 31 and the oil pressure of the second oil passage 32 by the electromagnetic relief valves 15 and 16 to adjust the flow rate and oil pressure of the operating oil supplied to the oil-pressure motor 33. With this, the oil-pressure motor 33 can be caused to output the target torque. Other than the above example, the oil-pressure motor 33 can be caused to output the target torque by utilizing a communication valve or a variable oil-pressure motor.

An operating liquid supply device such as the oil-pressure pump of the present embodiment may be used for the other actuators, such as a boom, an arm, a bucket, and a traveling device, of the hydraulic excavator or may be a turning independent system used only for the turning.

The electrohydraulic swing motor 17 configured by integrating the oil-pressure motor 33 and the electric motor 34 is used in the drive control system 1 of the present embodiment. However, the oil-pressure motor 33 and the electric motor 34 may be configured separately. The operating machine to which the drive control system 1 is applied is not limited to the hydraulic excavator 2, and the drive control system 1 may be applied to a hydraulic crane or the like. The operating liquid used in the drive control system 1 of the present embodiment is oil but is not limited to the oil and is only required to be a liquid.

Further, in the drive control system 1 of the present embodiment, selected as the high efficiency torque is the torque by which the electric power efficiency becomes the highest with respect to the target turning speed. The torque by which the electric power efficiency becomes the highest may be torque around the torque by which the electric power efficiency becomes the highest.

From the foregoing explanation, many modifications and other embodiments of the present invention are obvious to one skilled in the art. Therefore, the foregoing explanation should be interpreted only as an example and is provided for the purpose of teaching the best mode for carrying out the present invention to one skilled in the art. The structures and/or functional details may be substantially modified within the scope of the present invention.

REFERENCE SIGNS LIST

1 drive control system
2 hydraulic excavator
9 operating oil supply device
10 oil-pressure pump
11 control valve
12 remote control valve
17 electrohydraulic swing motor
28 capacitor
33 oil-pressure motor
34 electric motor
36 electric motor driving device
50 control device

The invention claimed is:

1. A drive control system of an operating machine,
the drive control system comprising:
a power storage device storing electric power;
an electric motor supplied with the electric power from the power storage device to operate and turn a structure of the operating machine;
an electric motor driving device configured to adjust the electric power supplied from the power storage device to the electric motor and drive the electric motor at torque corresponding to the supplied electric power;
a liquid-pressure motor supplied with an operating liquid to operate and turn the structure in cooperation with the electric motor;
an operating liquid supply device configured to adjust a flow rate and liquid pressure of the operating liquid flowing through the liquid-pressure motor and drive the liquid-pressure motor at torque corresponding to the flow rate and liquid pressure of the supplied operating liquid;
an input device by which a target turning speed of the structure is input; and
a drive control device configured to determine a target torque for accelerating the structure to the target turning speed and control an operation of the electric motor driving device and an operation of the operating liquid supply device such that a sum of the torque of the electric motor and the torque of the liquid-pressure motor becomes the target torque, wherein:
when accelerating the structure to the target turning speed, the drive control device controls the operation of the electric motor driving device such that the electric motor drives at high efficiency torque by which a highest electric power efficiency is obtained at each of rotating speeds of the electric motor before the speed of the structure reaches the target turning speed; and
the drive control device controls the operation of the operating liquid supply device such that residual torque obtained by subtracting the high efficiency torque from the target torque is output from the liquid-pressure motor.

2. The drive control system according to claim 1, wherein:
the drive control device stores an iso efficiency curve regarding the torque and the rotating speed, the iso efficiency curve being set based on the electric motor and the electric motor driving device;
the drive control device further stores the high efficiency torque that is torque at a contact point between the rotating speed before the speed of the structure reaches the target turning speed and the iso efficiency curve by which the highest efficiency is obtained with respect to the rotating speed; and
the drive control device controls the operation of the electric motor driving device such that the electric motor drives at the high efficiency torque.

3. The drive control system according to claim 1, wherein:
the electric motor is an AC motor which is supplied with an alternating current to drive;
the power storage device discharges a direct current;

the electric motor driving device converts the direct current, discharged from the power storage device, into the alternating current to supply the alternating current to the electric motor; and the drive control device controls the operation of the electric motor driving device such that the electric motor drives at the high efficiency torque by which the highest electric power efficiency is obtained regarding the electric power consumed by the electric motor and the electric motor driving device.

4. The drive control system according to claim 1, wherein:

the high efficiency torque of the electric motor is substantially equal to predetermined torque in a predetermined speed range; and in a case where the rotating speed before the speed of the structure reaches the target turning speed falls within the predetermined range, the drive control device calculates the high efficiency torque as the predetermined torque.

5. The drive control system according to claim 1, wherein:

the electric motor has a power generating function of converting kinetic energy of the turning structure into the electric power to reduce the speed of the structure; and the electric motor driving device supplies the electric power, converted by the electric motor, to the power storage device to store the electric power in the power storage device.

6. An operating machine comprising the drive control system according to claim 1.

7. A drive control method of an operating machine configured to cause an electric motor and a liquid-pressure motor to cooperate with each other to turn a structure of the operating machine, the electric motor being configured to operate in accordance with electric power supplied from a power storage device through an electric motor driving device, the liquid-pressure motor being configured to operate in accordance with a flow rate and liquid pressure of an operating liquid supplied from an operating liquid supply device, the drive control method comprising:

a target torque calculating step of calculating a target torque for accelerating the structure to a target turning speed input by an input device;

an electric power supply operation control step of controlling the electric power supplied from the electric motor driving device to the electric motor such that the electric motor drives at high efficiency torque by which a highest electric power efficiency is obtained at each of rotating speeds before the speed of the structure reaches the target turning speed; and an operating liquid supply operation control step of controlling an amount of operating liquid supplied from the operating liquid supply device such that residual torque obtained by subtracting the high efficiency torque from the target torque is output from the liquid-pressure motor.

* * * * *